US007652524B2

(12) United States Patent
Patent et al.

(10) Patent No.: US 7,652,524 B2
(45) Date of Patent: Jan. 26, 2010

(54) VOLTAGE SOURCE FOR GATE OXIDE PROTECTION

(75) Inventors: Dimitry Patent, Austin, TX (US); Ravinder Rachala, Austin, TX (US); Shawn Searles, Austin, TX (US); Lena Ahlen, La Grange, TX (US); Matthew Cooke, Austin, TX (US)

(73) Assignee: Advanced Micro Devices, Inc., Sunnyvale, CA (US)

( * ) Notice: Subject to any disclaimer, the term of this patent is extended or adjusted under 35 U.S.C. 154(b) by 16 days.

(21) Appl. No.: 12/018,297

(22) Filed: Jan. 23, 2008

(65) Prior Publication Data

US 2009/0184696 A1 Jul. 23, 2009

(51) Int. Cl.
*G05F 1/10* (2006.01)
*G05F 3/02* (2006.01)

(52) U.S. Cl. ..... 327/538; 327/539; 327/540

(58) Field of Classification Search ..... 327/538–543
See application file for complete search history.

(56) References Cited

U.S. PATENT DOCUMENTS 5,633,600 A * 5/1997 Ohnishi ..... 326/17
5,892,371 A 4/1999 Maley
5,955,915 A * 9/1999 Edwards ..... 327/541
6,157,360 A * 12/2000 Jeong et al. ..... 345/98
6,201,381 B1 * 3/2001 Yasuda ..... 323/315
6,437,958 B1 8/2002 Duncan et al.
6,459,533 B1 10/2002 Clapp et al.
6,593,790 B2 * 7/2003 Kim ..... 327/198
7,151,419 B2 * 12/2006 Hitomi et al. ..... 331/186
7,339,409 B2 * 3/2008 Choi et al. ..... 327/170
7,363,414 B2 * 4/2008 Do ..... 710/302
7,454,637 B2 * 11/2008 Er et al. ..... 713/323
2005/0195005 A1 * 9/2005 Choi et al. ..... 327/170
2007/0055896 A1 * 3/2007 Er et al. ..... 713/300
2009/0002031 A1 * 1/2009 Choi et al. ..... 326/87

* cited by examiner

*Primary Examiner*—Lincoln Donovan
*Assistant Examiner*—Adam D Houston
(74) *Attorney, Agent, or Firm*—Meyertons, Hood, Kivlin, Kowert & Goetzel, P.C.; Erik A. Heter

(57) ABSTRACT

An electronic circuit. The electronic circuit includes a first circuit leg coupled to a first supply voltage node and a second supply voltage node. The first circuit leg includes a first reference current circuit configured to produce a first reference current and a second reference current circuit configured to produce a second reference current. The electronic circuit further includes a second circuit leg coupled in parallel with the first circuit leg. The second circuit leg includes a first transistor coupled to form a current mirror with the first reference current circuit and a second transistor coupled to form a current mirror with the second reference current circuit. The source terminals of each of the first and second transistors are coupled together to form a third supply voltage node.

20 Claims, 3 Drawing Sheets

VOLTAGE SOURCE FOR GATE OXIDE PROTECTION

BACKGROUND OF THE INVENTION

1. Field of the Invention

This invention relates to electronic circuits, and more particularly, circuits that function as sources of voltage and current.

2. Description of the Related Art

As integrated circuit technology advances, the size of individual features within integrated circuits decreases. These smaller feature sizes can lead to competing demands in the design of these devices. In some cases, these competing demands pit maximum stress voltages for various transistor devices against voltage requirements.

Transistor devices in integrated circuit are typically rated for maximum gate oxide stress voltages, which are voltages between the gate terminal and one of the other transistor terminals. If the gate oxide voltage is exceeded for a given transistor, it may cause irreversible damage. Thus, the gate oxide voltages across transistors in a circuit is typically limited, by design.

However, in some cases, the rail-to-rail voltages required for a given circuit may compete with a requirement smaller gate oxide voltages. In some cases, these competing demands may result in a compromise on one or the other. For example, if the requirement for greater rail-to-rail voltages is critical, while the requirement for smaller devices (in terms of maximum gate oxide voltage), then larger devices may be used. Alternatively, if the requirement for smaller devices is more critical than the requirement for higher rail-to-rail voltages, the circuits may be designed using smaller rail-to-rail voltages. Yet a third way of meeting these competing demands may include the implementation of multiple voltage domains and the use of level shifter circuits.

SUMMARY OF THE INVENTION

An electronic circuit is disclosed. In one embodiment the electronic circuit includes a first circuit leg coupled to a first supply voltage node and a second supply voltage node. The first circuit leg includes a first reference current circuit configured to produce a first reference current and a second reference current circuit configured to produce a second reference current. The electronic circuit further includes a second circuit leg coupled in parallel with the first circuit leg. The second circuit leg includes a first transistor coupled to form a current mirror with the first reference current circuit and a second transistor coupled to form a current mirror with the second reference current circuit. The source terminals of each of the first and second transistors are coupled together to form a third supply voltage node. The voltage present on the third supply voltage node is approximately midway between the voltages present on the first and second supply voltage nodes.

An integrated circuit is also disclosed. The integrated circuit includes a core logic circuit. A plurality of driver circuits is coupled to the core logic circuit and are each configured to drive a corresponding signal from the integrated circuit. Each of the driver circuits is coupled to first and second supply voltage node coupled to provide first and second supply voltages, respectively. A third supply voltage node is also coupled to supply a third supply voltage to each of the driver circuits. A a plurality of voltage source circuits are each coupled to provide the third supply voltage to one or more of the plurality of driver circuits.

BRIEF DESCRIPTION OF THE DRAWINGS

Other aspects of the invention will become apparent upon reading the following detailed description and upon reference to the accompanying drawings in which.

Figure 1:
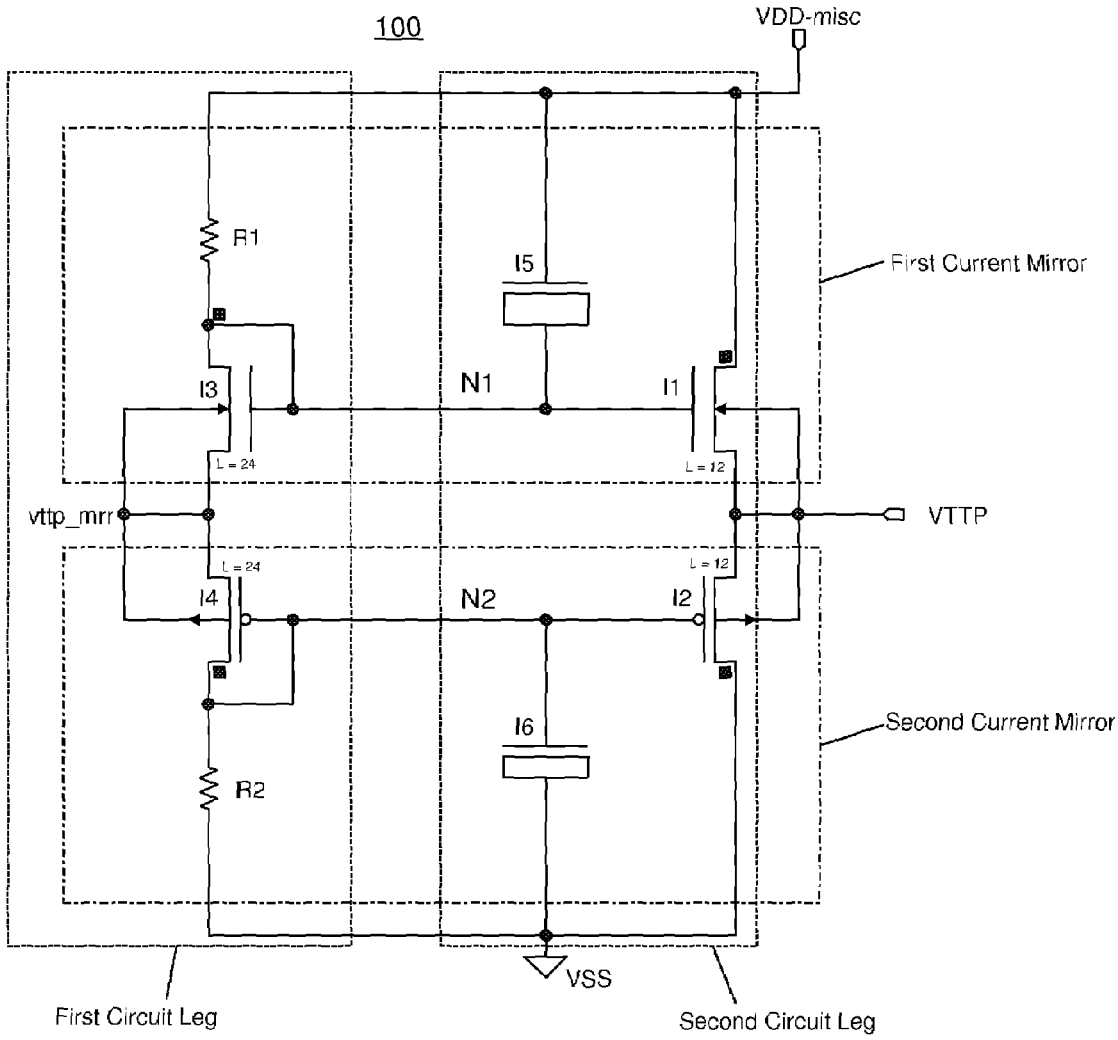
FIG. 1 is a schematic diagram of one embodiment of a circuit configured to function as both a voltage source and a current source.

While the invention is susceptible to various modifications and alternative forms, specific embodiments thereof are shown by way of example in the drawings and will herein be described in detail. It should be understood, however, that the drawings and description thereto are not intended to limit the invention to the particular form disclosed, but, on the contrary, the invention is to cover all modifications, equivalents, and alternatives falling with the spirit and scope of the present invention as defined by the appended claims.

DETAILED DESCRIPTION OF THE INVENTION

Turning now to FIG. 1, a schematic diagram of one embodiment of a circuit configured to function as both a voltage source and a current source is shown. In the embodiment shown, circuit 100 can be partitioned in two different ways—as a first and second current mirror, and as having a first circuit leg and a second circuit leg. The partitions of the circuit are delineated by the dashed lines.

The first circuit leg of circuit 100 includes a first reference current circuit and a second reference current circuit. The first reference current circuit includes resistor R1 and the diode-coupled transistor I3. The second reference current circuit includes resistor R2 and the diode-coupled transistor I4. In the embodiment shown, transistors I3 and I4 are NMOS and PMOS transistors, respectively, although other embodiments are possible and contemplated. The two reference current circuits set up a reference current through the first circuit leg, between the voltage nodes of VDD-misc and VSS. When current if flowing through the first circuit leg, resistors R1 and R2 create voltage drops that result in an intermediate voltage, vttp_mrrr between the drain terminals of I3 and I4.

The second circuit leg of circuit 100 includes transistors I1 and I2. The gate terminal of transistor I1 is coupled to the gate terminal of transistor I3, and thus forms the first current mirror. Similarly, the gate terminal of transistor I2 is coupled to the gate terminal of transistor I4, and forms the second current mirror. Transistor I1 is, in this embodiment, an NMOS device, while transistor I2, in this embodiment, is a PMOS device.

The second circuit leg also includes a first capacitor and a second capacitor. The first capacitor is implemented as capacitor-coupled transistor I5, coupled as shown between VDD-misc and the node of the gate terminals for I1 and I3, N1. The second capacitor is implemented as capacitor coupled transistor I6, coupled as shown between the node of the gate terminals of I2 and I4, N2, and the VSS node. In other embodiments, these capacitors may be implemented with traditional capacitors instead of with transistors. Regardless of the implementation, the capacitors of circuit 100 stabilizes the voltages across resistors R1 and R2, and thereby enables a stable output voltage.

In the second circuit leg, the drains of transistors I1 and I2 are coupled together at the node VTTP. This voltage can be used as a source voltage for other circuits wherein a full-rail voltage swing between VDD-misc and VSS is required, but protection of the gate oxides of transistors in the other circuits is necessary. For example, in some integrated circuits, the output drivers may require a full-rail voltage swing of 1.8 volts. However, due to design requirements of the integrated circuit, the maximum gate oxide voltage may be on the order of 1.1-1.2 volts. Thus, by properly sizing transistors I3 and I4 while providing substantially equal resistances in R1 and R2, the voltage at VTTP can be set to approximately 0.9 volts. This voltage can then be provided to circuits to enable both the is full-rail voltage swing while protecting the gate oxides of the transistors implemented therein. The voltage on VTTP may float within a small range, but generally, will be equal or close to the voltage of vttp_mrr.

During operation of circuit 100, the current through the first leg of the circuit is mirrored in the second leg of the circuit. More particularly, the current through R1 and I3 is mirrored through I1, while the current through R2 and I4 is mirrored through transistor I2. The first and second current mirrors are capable of operating substantially independent of each other, sourcing/sinking current as necessary while maintaining the voltage on the VTTP node. The first current mirror is capable of sourcing current from VDD-misc to VTTP, while the second current mirror is capable of sinking current from VTTP to VSS. More particularly, current may be sourced to VTTP through transistor I1, while current may be sunk to VSS through transistor I2.

A notable feature of circuit 100 is that the transistors of the first circuit leg have channel lengths that are longer than the transistors of the second leg. In this example, the channel lengths of I3 and I4 (L=24) are twice that of transistors I1 and I2 (L=12). Channel length ratios of other than 2:1 are possible and contemplated, as the scaling of the channel lengths may vary in accordance with the requirements of the particular application in which circuit 100 is to be used. The transistors of the first circuit leg have a lower threshold voltage, $V_t$, due to their longer channel lengths. This results in the transistors of the first circuit leg operating with a higher overdrive voltage, $V_{dsat}$, which in turn also results in the transistors in the second circuit leg operating with the higher overdrive voltage by virtue of the current mirror configuration. Thus, with a higher threshold voltage combined with the higher overdrive voltage, transistors I1 and I2 are capable of sourcing/sinking (respectively) larger amounts of current than I3 and I4. This ability to source/sink large amounts of current is provided without sacrificing the stability of the voltage on VTTP, since both I1 and I2 are coupled to a stable gate voltage provided by transistors I3 and I4, respectively. The presence of capacitors in the form of transistors I5 and I6 further stabilize the gate voltages of transistors I2 and I2, respectively.

The arrangement of circuit 100 allows it to provide functions of both a voltage divider and a feedback stabilized voltage regulator without the disadvantages of either. Circuit 100 is capable of providing the same voltage division function of a typical voltage divider circuit, but also incorporates the ability to source and sink large and varying amounts of current while providing a stable voltage. Typical voltage dividers lack the ability to source and sink large, varying amounts of current. Furthermore, circuit 100 is capable of offering a stable output voltage typical of that of a feedback stabilized voltage regulator using less circuit area on an integrated circuit die. Therefore, circuit 100 may be particularly useful for providing an additional source voltage to circuits utilizing transistors whose maximum gate oxide voltage is less than the overall voltage swing of an output signal of the circuit.

Figure 2:
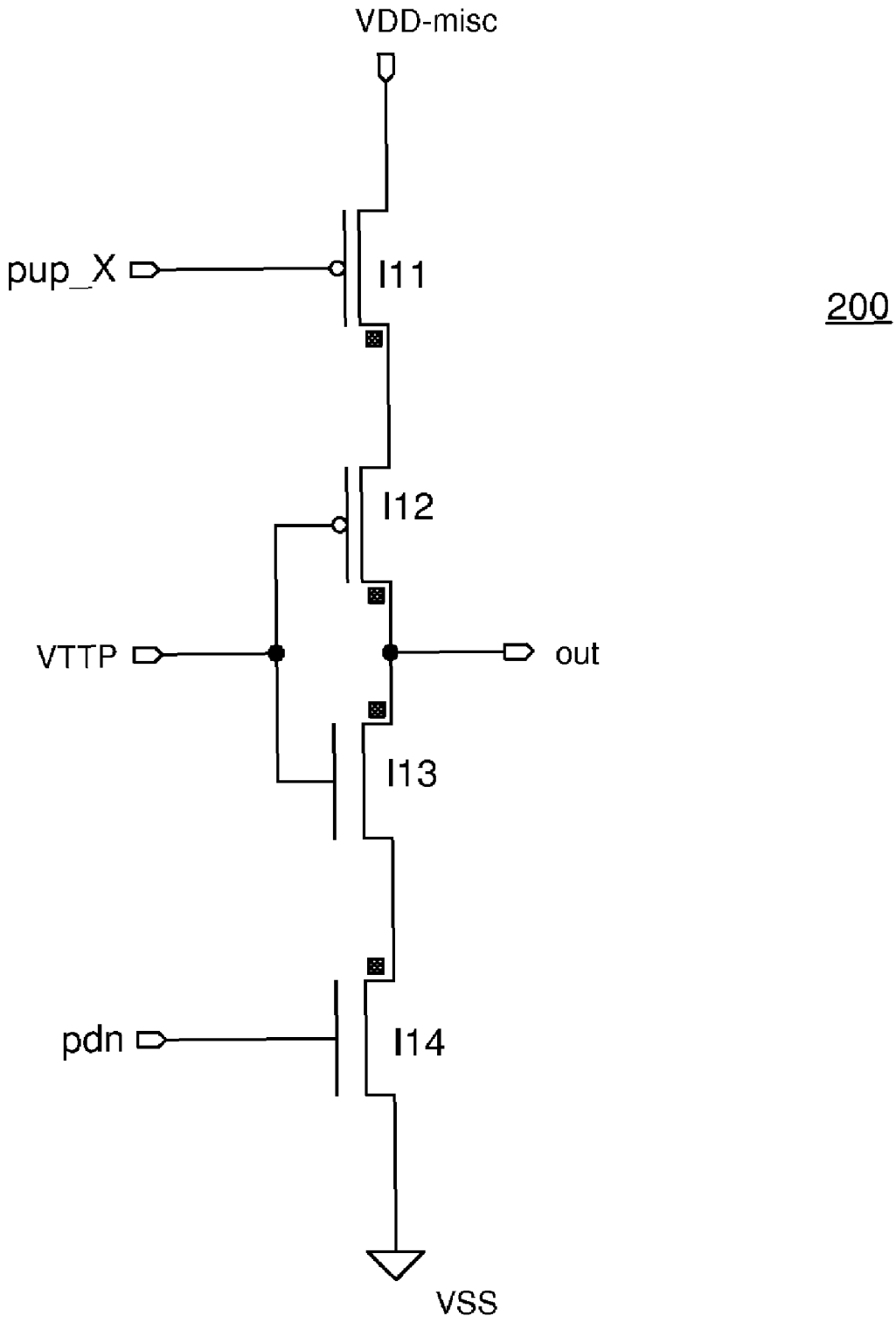
FIG. 2 is a schematic diagram of one embodiment of an output driver circuit configured to use the voltage generated by the circuit of FIG. 1.

One such instance of a circuit with which circuit 100 would be useful is shown in FIG. 2. Turning now to FIG. 2, FIG. 2 a schematic diagram of one embodiment of an output driver circuit configured to use the voltage generated by the circuit of FIG. 1 is shown. Driver circuit 200 is a driver circuit, with an output node (out) that swings full rail between VDD-misc and VSS, even though this voltage swing is greater than the gate oxide voltage of any of the transistors used therein. An example of such a circuit would be a driver circuit for a microprocessor to be implemented according to certain specifications on a motherboard. The microprocessor may specify the use of transistors that have a maximum gate-oxide voltage of 1.2 volts, while the motherboard required output drivers to have a voltage swing of 1.8 volts. These conflicting requirements may be circumvented by the use of a voltage source according to the circuit of FIG. 1 along with a driver circuit according to FIG. 2.

In the embodiment shown, transistors I11 and I12 are PMOS transistors coupled in a cascade configuration. Similarly, transistors I13 and I14 are NMOS transistors coupled in a cascade configuration. The gate terminals of transistors I12 and I13 are both coupled to receive an intermediate voltage from the VTTP node of a voltage source circuit such as circuit 100 of FIG. 1. The signal provided on the output node of driver circuit 200 is dependent upon which of transistors I11 or I14 is activated. The gate terminals of both transistors I11 and I14 are coupled to other logic circuitry (e.g., a core logic unit of a microprocessor) and coupled to receive signals indicating the voltage level (and thus logic level) that is to be driven on the output node. It should be noted that the logic circuitry coupled to the pdn and pup_X nodes is configured such that only one of these nodes is active at a given time (and thus, only one of I11 or I14 can be turned on at a given time).

If a high voltage (i.e. logic one) signal is to be driven from driver circuit 200, a voltage level appropriate to activate transistor I11 is driven to the gate thereof via the pup_X node. This voltage is sufficiently low to turn on PMOS I11, but yet sufficient that the voltage difference between VDD-misc and pup_X is less than the specified maximum gate oxide voltage. When transistor I11 becomes active, the voltage on the output node is pulled up toward VDD-misc through transistors I11 and I12. However, since the gate terminal of I12 is coupled to receive the intermediate voltage via node VTTP, neither I11 nor I12 is exposed to the full-rail voltage difference between VDD-misc and VSS.

When a low voltage (i.e. logic zero) signal is to be driven from driver circuit 200, a voltage sufficient to activate NMOS I14 is driven to its gate. This voltage, while being large enough to turn on I14, is small enough that the voltage difference between pdn and VSS is less than the specified maximum gate oxide voltage. When transistor I14 is turned on, the voltage on the output node is pulled down toward VSS through transistors I13 and I14. However, since the gate terminal of I13 is coupled to receive the intermediate voltage via node VTTP, neither I13 nor I14 is exposed to the full-rail voltage difference between VDD-misc and VSS.

Figure 3:
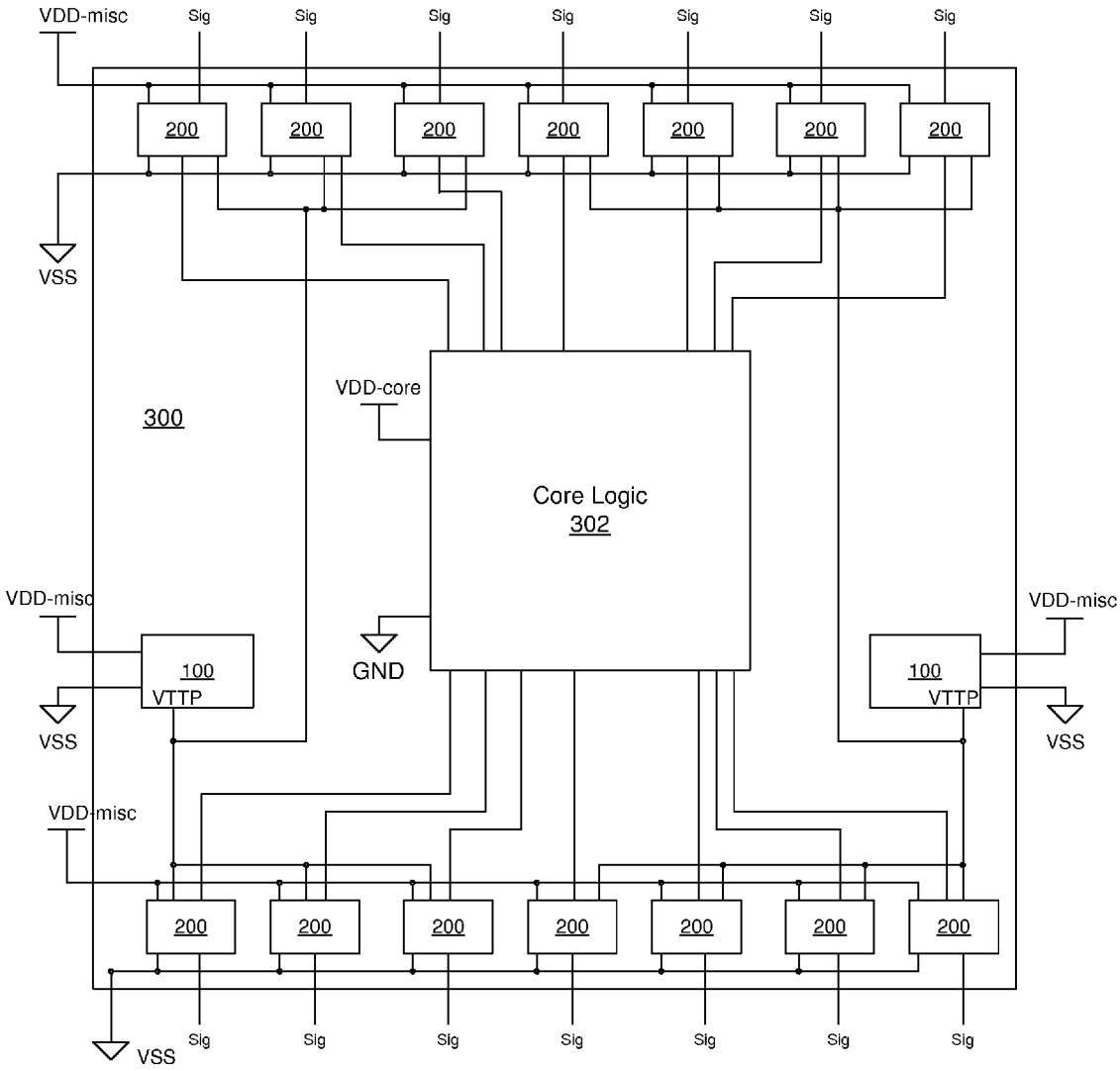
FIG. 3 is a block diagram of one embodiment of an integrated circuit requiring different voltages for various functions.

Turning now to FIG. 3, a block diagram of one embodiment of an integrated circuit requiring different voltages for various functions is shown. In the embodiment shown, integrated circuit 300 includes a core logic 302 coupled to a plurality of I/O circuits 200. The I/O circuits 200 include a plurality of driver circuits such as driver circuit 200 as shown in FIG. 2, but may also include receiver circuits coupled to receive signals and convey them to core logic 302. Each of the I/O circuits 200 is coupled to voltage nodes VDD-misc and VSS, while core logic is coupled to voltage nodes VDD-core and GND. The voltage swing between VDD-core and GND is less than that of VDD-misc and VSS.

Integrated circuit 300 is implemented using transistors that have a maximum rated gate oxide voltage that is less than the voltage swing between VDD-misc and VSS. This discrepancy does not affect the transistors of core logic 302, which are only exposed to the voltage difference between VDD-core and GND. In order to prevent the transistors of the I/O circuits 200 from being exposed to the full voltage swing between VDD-misc and VSS (and thereby prevent overstressing of their gate oxides), a plurality of circuits 100 are provided, with each being coupled to the VDD-misc and VSS nodes. Each of circuits 100 provides an intermediate voltage to the I/O circuits 200 coupled thereto via their respective output nodes VTTP. Thus, in accordance with the discussion above, the presence of the intermediate voltage on the VTTP nodes shown prevent the transistors of I/O circuits 200 from being exposed to the full voltage swing between VDD-misc and VSS, and thereby prevent overstressing of their respective gate oxides.

While the present invention has been described with reference to particular embodiments, it will be understood that the embodiments are illustrative and that the invention scope is not so limited. Any variations, modifications, additions, and improvements to the embodiments described are possible. These variations, modifications, additions, and improvements may fall within the scope of the inventions as detailed within the following claims.

What is claimed is:

1. An electronic circuit comprising:

a first circuit leg coupled to a first supply voltage node and a second supply voltage node, the first circuit leg including:

a first reference current circuit configured to produce a first reference current; and a second reference current circuit configured to produce a second reference current; and a second circuit leg coupled in parallel with the first circuit leg, the second circuit leg including:

a first transistor coupled to form a first current mirror with the first reference current circuit; and a second transistor coupled to form a second current mirror with the second reference current circuit;

wherein source terminals of each of the first and second transistors are coupled together to form a third supply voltage node.

2. The electronic circuit as recited in claim 1, wherein a voltage of the third supply voltage node is approximately half way between a voltage on the first supply voltage node and the second supply voltage node.

3. The electronic circuit as recited in claim 1, wherein the first reference current circuit includes:

a third transistor, wherein the third transistor is diode-coupled and has a gate coupled to a gate of the first transistor; and a first resistor coupled between the first supply voltage node and a drain of the third transistor; and wherein the second reference circuit includes:

a fourth transistor, wherein the fourth transistor is diode-coupled and has a gate coupled to a gate of the second transistor; and a second resistor coupled between the second supply voltage node and a drain of the fourth transistor.

4. The electronic circuit as recited in claim 3, wherein the first and second transistors each have a shorter channel length than the third and fourth transistors, respectively.

5. The electronic circuit as recited in claim 4, wherein the first and second transistors have a first channel length and the third and fourth transistors have a second channel length, wherein the second channel length is approximately twice the first channel length.

6. The electronic circuit as recited in claim 3, wherein the first and third transistors are NMOS devices, and wherein the second and fourth transistors are PMOS devices.

7. The electronic circuit as recited in claim 1 further comprising:

a first capacitor coupled between the first supply voltage node and a gate of the first transistor; and a second capacitor coupled between the second supply voltage node and a gate of the second transistor.

8. The electronic circuit as recited in claim 1, wherein the first transistor is arranged to source current to the third supply voltage node, and wherein the second transistor is arranged to sink current from the third supply voltage node.

9. An integrated circuit comprising:

a core logic circuit;

a plurality of driver circuits each coupled to the core logic circuit and configured to drive a signal from the integrated circuit, wherein each driver circuit is coupled to first and second supply voltage nodes; and a plurality of voltage source circuits each coupled to provide a third supply voltage to one or more of the plurality of driver circuits, wherein each of the plurality of voltage source circuits includes:

a first circuit leg coupled to the first and second supply voltage nodes, the first circuit leg including:

a first reference current circuit configured to produce a first reference current; and a second reference current circuit configured to produce a second reference current; and a second circuit leg coupled in parallel with the first circuit leg, the second circuit leg including:

a first transistor coupled to form a first current mirror with the first reference current circuit; and a second transistor coupled to form a second current mirror with the second reference current circuit;

wherein source terminals of each of the first and second transistors are coupled together and form a third supply voltage node from which the third supply voltage is provided.

10. The integrated circuit as recited in claim 9, wherein the voltage of the third supply voltage node is approximately half way between a voltage on the first supply voltage node and the second supply voltage node.

11. The integrated circuit as recited in claim 10, wherein the first reference current circuit includes:

a third transistor, wherein the third transistor is diode-coupled and has a gate coupled to a gate of the first transistor; and a first resistor coupled between the first supply voltage node and a drain of the third transistor; and wherein the second reference circuit includes:

a fourth transistor, wherein the fourth transistor is diode-coupled and has a gate coupled to a gate of the second transistor; and a second resistor coupled between the second supply voltage node and a drain of the fourth transistor.

12. The integrated circuit as recited in claim 11, wherein the first and second transistors each have a shorter channel length than the third and fourth transistors, respectively.

13. The integrated circuit as recited in claim 12, wherein the first and second transistors have a first channel length and the third and fourth transistors have a second channel length, wherein the second channel length is approximately twice the first channel length.

14. The integrated circuit as recited in claim 11, wherein the first and third transistors are NMOS devices, and wherein the second and fourth transistors are PMOS devices.

15. The integrated circuit as recited in claim 9, wherein each of the plurality of voltage source circuits further comprises:

a first capacitor coupled between the first supply voltage node and a gate of the first transistor; and a second capacitor coupled between the second supply voltage node and a gate of the second transistor.

16. The integrated circuit as recited in claim 9, wherein the first transistor is arranged to source current to the third supply voltage node, and wherein the second transistor is arranged to sink current from the third supply voltage node.

17. The integrated circuit as recited in claim 9, wherein each of the plurality of driver circuits includes a first pair of transistors coupled in a cascode configuration between the first supply voltage node and the third supply voltage node, and a second pair of transistors coupled in a cascode configuration between the second supply voltage node and the third supply voltage node, and wherein a gate oxide stress voltage maximum for each transistor of the first and second pairs is less than a magnitude of the voltage difference between voltages of the first and second supply voltage nodes.

18. An electronic circuit comprising:

first circuit means for providing electrical current, said first circuit means being coupled to a first supply voltage node at a first voltage; and second circuit means for providing electrical current, said second circuit means being coupled to a second supply voltage node at a second voltage;

wherein the first circuit means and the second circuit means are coupled together to form a third supply voltage node for supplying a third voltage, wherein the third voltage is at a value approximately halfway between the first voltage and the second voltage; and wherein said first circuit means is configured to source current to the third supply voltage node and said second circuit means is configured to sink current from the third supply voltage node.

19. The electronic circuit as recited in claim 18, wherein said first circuit means includes:

first and second transistors coupled in a current mirror configuration, wherein the first transistor is diode-coupled;

and wherein said second circuit means includes:

third and fourth transistors coupled in a current mirror configuration, wherein the third transistor is diode coupled; and wherein a channel length of each of the first and third transistors is longer than a channel length of each of the second and fourth transistors, respectively.

20. The electronic circuit as recited in claim 19, wherein the first and third transistors have a first channel length, and the second and fourth transistors have a second channel length, wherein the first channel length is approximately twice the second channel length.

* * * * *